US009956595B2

(12) United States Patent
Sato et al.

(10) Patent No.: US 9,956,595 B2
(45) Date of Patent: May 1, 2018

(54) ULTRASONIC CLEANER

(71) Applicant: Toyota Jidosha Kabushiki Kaisha, Toyota-shi Aichi-ken (JP)

(72) Inventors: Takayasu Sato, Takahama (JP); Yoji Sato, Kasugai (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days. days.

(21) Appl. No.: 15/219,895

(22) Filed: Jul. 26, 2016

(65) Prior Publication Data

US 2017/0036251 A1 Feb. 9, 2017

(30) Foreign Application Priority Data

Aug. 6, 2015 (JP) ..... 2015-155960

(51) Int. Cl.

| | |
|---|---|
| ***B06B 3/04*** | (2006.01) |
| ***B08B 3/12*** | (2006.01) |
| ***B08B 7/02*** | (2006.01) |
| ***B06B 3/00*** | (2006.01) |

(52) U.S. Cl.

CPC ..... *B08B 3/12* (2013.01); *B06B 3/00* (2013.01); *B06B 3/04* (2013.01); *B08B 7/028* (2013.01); *B06B 2201/71* (2013.01); *B08B 2203/0288* (2013.01)

(58) Field of Classification Search

CPC ..... B06B 3/04; B06B 2201/71; B08B 3/12; B08B 7/028; B08B 2203/0288

USPC ..... 134/115 R

See application file for complete search history.

(56) References Cited

U.S. PATENT DOCUMENTS 6,719,850 B2 * 4/2004 Glucksman ..... A47L 25/00 134/1

FOREIGN PATENT DOCUMENTS

| | | | |
|---|---|---|---|
| JP | 64-58389 | A | 3/1989 |
| JP | H08281226 | A | 10/1996 |
| JP | 10-277485 | A | 10/1998 |
| JP | H1127701 | A | 1/1999 |
| JP | 2012-200611 | A | 10/2012 |

* cited by examiner

*Primary Examiner* — Levon J Shahinian

(74) *Attorney, Agent, or Firm* — Dinsmore & Shohl LLP

(57) ABSTRACT

An ultrasonic cleaner is provided. The ultrasonic cleaner includes: a first ultrasonic vibrator configured to generate a first ultrasonic wave; a first oscillator configured to drive the first ultrasonic vibrator; a wash tank configured to store a detergent solution; and an attenuation mechanism configured to damp vibration of the wash tank. The wash tank includes a parabolic surface which is a recessed surface facing a vibration surface of the first ultrasonic vibrator, and is configured to reflect the first ultrasonic wave to a focal position where an object to be cleaned is placed. The vibration of the wash tank is generated by the first ultrasonic wave impinging on the wash tank.

8 Claims, 6 Drawing Sheets

ULTRASONIC CLEANER

CROSS-REFERENCE TO RELATED APPLICATION(S)

This application claims priority to Japanese Patent Application No. 2015-155960 filed on Aug. 6, 2015, the entire content of which is incorporated by reference.

BACKGROUND

1. Technical Field

The disclosure relates to an ultrasonic cleaner.

2. Description of Related Art

An ultrasonic cleaner includes an ultrasonic vibrator, an oscillator for vibrating the ultrasonic vibrator, and a wash tank for immersing a cleaning object in a detergent solution. The cleaning object is cleaned by using an ultrasonic wave emitted from the ultrasonic vibrator.

For example, Japanese Patent Application Publication No. 1-58389 (JP 1-58389 A) discloses an ultrasonic cleaner including a wash tank having a parabolic surface that faces a vibration surface of an ultrasonic vibrator. In this apparatus, an ultrasonic wave emitted from the ultrasonic vibrator is reflected by the parabolic surface so as to be focused on a cleaning object, thereby increasing the cleaning effect by the ultrasonic wave.

SUMMARY

When the ultrasonic wave emitted from the ultrasonic vibrator impinges on the wash tank so that the wash tank vibrates, the parabolic surface also vibrates. Therefore, the shape of the parabolic surface changes to make it difficult to maintain a certain shape, resulting in a decrease in the ultrasonic wave focusing effect. Accordingly, even if the wash tank is formed with the parabolic surface, the effect of focusing the ultrasonic wave on the cleaning object is not sufficiently obtained and thus there is a possibility that the ultrasonic wave cannot be efficiently irradiated on the cleaning object, so that there is still room for further improvement.

The disclosure provides an ultrasonic cleaner that can irradiate an ultrasonic wave on a cleaning object more effectively.

According to one aspect of the disclosure, an ultrasonic cleaner is provided. The ultrasonic cleaner includes: a first ultrasonic vibrator configured to generate a first ultrasonic wave; a first oscillator configured to drive the first ultrasonic vibrator; a wash tank configured to store a detergent solution; and an attenuation mechanism configured to damp vibration of the wash tank. The wash tank includes a parabolic surface which is a recessed surface facing a vibration surface of the first ultrasonic vibrator, and is configured to reflect the first ultrasonic wave to a focal position where an object to be cleaned is placed. The vibration of the wash tank is generated by the first ultrasonic wave impinging on the wash tank.

According to this configuration, the attenuation mechanism is provided so that the vibration of the wash tank is damped. Therefore, the change in the shape of the parabolic surface due to the vibration of the wash tank decreases so that a decrease in the ultrasonic wave focusing effect can be suppressed. Accordingly, it is possible to irradiate an ultrasonic wave on the cleaning object more effectively.

According to the above mentioned aspect, the attenuation mechanism may include an outer tank housing the wash tank, and a vibration-attenuation material that is filled between an outer peripheral surface of the wash tank and an inner peripheral surface of the outer tank.

As the vibration-damping material, there can be cited a well-known material such as, for example, silicone gel, a liquid with a high viscosity, rubber, or felt.

According to this configuration, when the wash tank vibrates, the distance between the wash tank and the outer tank changes to deform the vibration-damping material so that the vibration energy is converted to heat. Therefore, the vibration of the wash tank can be damped so that the change in the shape of the parabolic surface due to the vibration of the wash tank can be made smaller.

According to the above mentioned aspect, the attenuation mechanism may include an outer tank housing the wash tank, and a spring disposed between an inner peripheral surface of the outer tank and an outer peripheral surface of the wash tank so as to support the wash tank on an inner side of the outer tank.

According to this configuration, when the wash tank vibrates, the distance between the wash tank and the outer tank changes to deform the spring so that the vibration energy is converted to heat. Therefore, the vibration of the wash tank can be damped so that the change in the shape of the parabolic surface due to the vibration of the wash tank can be made smaller.

According to the above mentioned aspect, the attenuation mechanism may include a second ultrasonic vibrator disposed on a wall surface of the wash tank, and a second oscillator which is configured to generate a second ultrasonic wave from the second ultrasonic vibrator. A waveform of the second ultrasonic wave is opposite in phase to a vibration waveform of a portion, where the second ultrasonic vibrator is disposed, of the wash tank generated by the first ultrasonic wave.

According to this configuration, the vibration of the wash tank is cancelled by the opposite-phase ultrasonic wave outputted from the second ultrasonic vibrator so that the vibration of the wash tank is damped. Therefore, the change in the shape of the parabolic surface due to the vibration of the wash tank can be made smaller.

According to the above mentioned aspect, the second ultrasonic vibrator may be disposed on the wall surface of the wash tank at a portion facing the vibration surface of the first ultrasonic vibrator. According to this configuration, the opposite-phase ultrasonic wave is transmitted to the wall surface of the wash tank at the portion facing the vibration surface of the first ultrasonic vibrator, i.e. to the parabolic surface provided to the wash tank, so that the vibration of the parabolic surface can be directly damped by the ultrasonic wave.

According to the above mentioned aspect, a plurality of the second ultrasonic vibrators may be disposed on the wall surface of the wash tank, and vibration waveforms of the wash tank at positions where the plurality of the second ultrasonic vibrators are disposed are the same as each other.

The greater the amplitude of an ultrasonic wave, the higher the cleaning effect by the ultrasonic wave. Further, when an ultrasonic wave is emitted in a conic solid toward its tapered distal end portion, the amplitude of the emitted ultrasonic wave is amplified in the conic solid. The conic solid includes cones and pyramids. In view of this, in the ultrasonic cleaner according to the above-described aspect, According to this configuration, since an ultrasonic wave outputted from the ultrasonic vibrator is amplified, the cleaning effect by the ultrasonic wave is further enhanced.

According to the above mentioned aspect, the wash tank may have a shape of a conic solid such that an external shape tapers toward the parabolic surface from a disposed position of the first ultrasonic vibrator.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
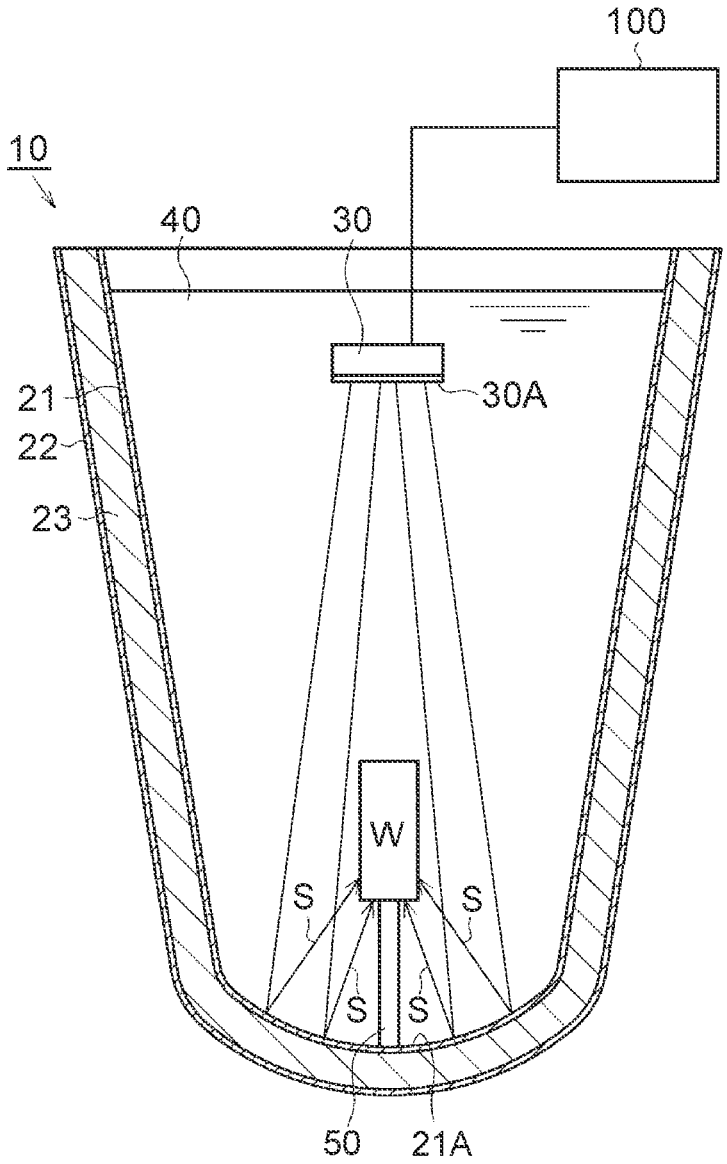
FIG. 1 is a sectional view showing the structure of a wash tank of an ultrasonic cleaner in a first embodiment.

Hereinbelow, a first embodiment of an ultrasonic cleaner will be described with reference to FIGS. 1 to 3. As shown in FIG. 1, an ultrasonic cleaner 10 includes a wash tank 21 in which a detergent solution 40 is stored. An ultrasonic vibrator 30 is disposed near a liquid surface in the detergent solution 40 stored in the wash tank 21. The ultrasonic vibrator 30 has a vibration surface 30A that generates an ultrasonic wave. The vibration surface 30A faces a bottom surface of the wash tank 21.

The ultrasonic vibrator 30 is connected to an oscillator 100 that outputs a high-frequency voltage. The ultrasonic vibrator 30 is driven by the oscillator 100. By adjusting the frequency and voltage of a high-frequency voltage of the oscillator 100, the frequency and amplitude of an ultrasonic wave emitted from the ultrasonic vibrator 30 are adjusted.

A surface, facing the vibration surface 30A of the ultrasonic vibrator 30, of the wash tank 21, i.e. the bottom surface of the wash tank 21, is formed as a parabolic surface 21A forming a recess with respect to the vibration surface 30A.

The wash tank 21 has a conical shape such that its external shape tapers toward the parabolic surface 21A from the disposed position of the ultrasonic vibrator 30. A rod-like fixing portion 50 is provided at a central portion of the parabolic surface 21A and extends therefrom in a disposition direction of the ultrasonic vibrator 30 and a cleaning object W is fixed to a distal end of the fixing portion 50. The length of the fixing portion 50 is set so that the cleaning object W is placed at a focal position of the parabolic surface 21A.

The ultrasonic cleaner 10 of this embodiment includes an attenuation mechanism that damps the vibration of the wash tank 21. This attenuation mechanism includes an outer tank 22 housing the wash tank 21, and a vibration-damping material 23 filled between an outer peripheral surface of the wash tank 21 and an inner peripheral surface of the outer tank 22.

The shape of the outer tank 22 is similar to the shape of the wash tank 21, while the shape of the outer tank 22 is slightly larger than the shape of the wash tank 21. That is, it is configured that the entire outer peripheral surface of the wash tank 21 is spaced apart from the entire inner peripheral surface of the outer tank 22 by a certain distance. Further, the vibration-damping material 23 is filled between the entire outer peripheral surface of the wash tank 21 and the entire inner peripheral surface of the outer tank 22. In this embodiment, silicone gel is used as the vibration-damping material 23, but another material may alternatively be used. For example, as the vibration-damping material 23, use may be made of a liquid with a high viscosity suitable for damping the vibration of the wash tank 21, rubber, felt, or the like.

Next, the actions created by the ultrasonic cleaner 10 of this embodiment will be described. As shown in FIG. 1, an ultrasonic wave S outputted from the ultrasonic vibrator 30 is transmitted through the detergent solution 40 and impinges on the parabolic surface 21A. The ultrasonic wave S impinging on the parabolic surface 21A is reflected by the parabolic surface 21A so as to be focused at the focal position of the parabolic surface 21A. Since the cleaning object W fixed to the fixing portion 50 is placed at this focal position, the cleaning object W is cleaned by the focused ultrasonic wave S.

Herein, when the ultrasonic wave S emitted from the ultrasonic vibrator 30 impinges on the inner wall of the wash tank 21, the wash tank 21 vibrates and thus the parabolic surface 21A also vibrates. When the parabolic surface 21A vibrates in this way, the shape of the parabolic surface 21A changes to make it difficult to maintain a certain shape and therefore there is a possibility that the effect of focusing the ultrasonic wave S may decrease.

In view of this, in order to confirm that the ultrasonic wave focusing effect is improved by suppressing the change in the shape of the parabolic surface 21A, simulations were carried out. FIG. 2 shows the results of the simulations. FIG. 2 shows the results of reproducing, by simulations, the pressures at a central portion of a wash tank between a bottom surface of the wash tank and an ultrasonic vibrator in a detergent solution during ultrasonic cleaning. The pressures indicated by a solid line L1 are the reproduced results when the shape of a parabolic surface was not changed to maintain a certain shape, while the pressures indicated by a one-dot chain line L2 are the reproduced results when the shape of the parabolic surface was changed by vibration.

Figure 2:
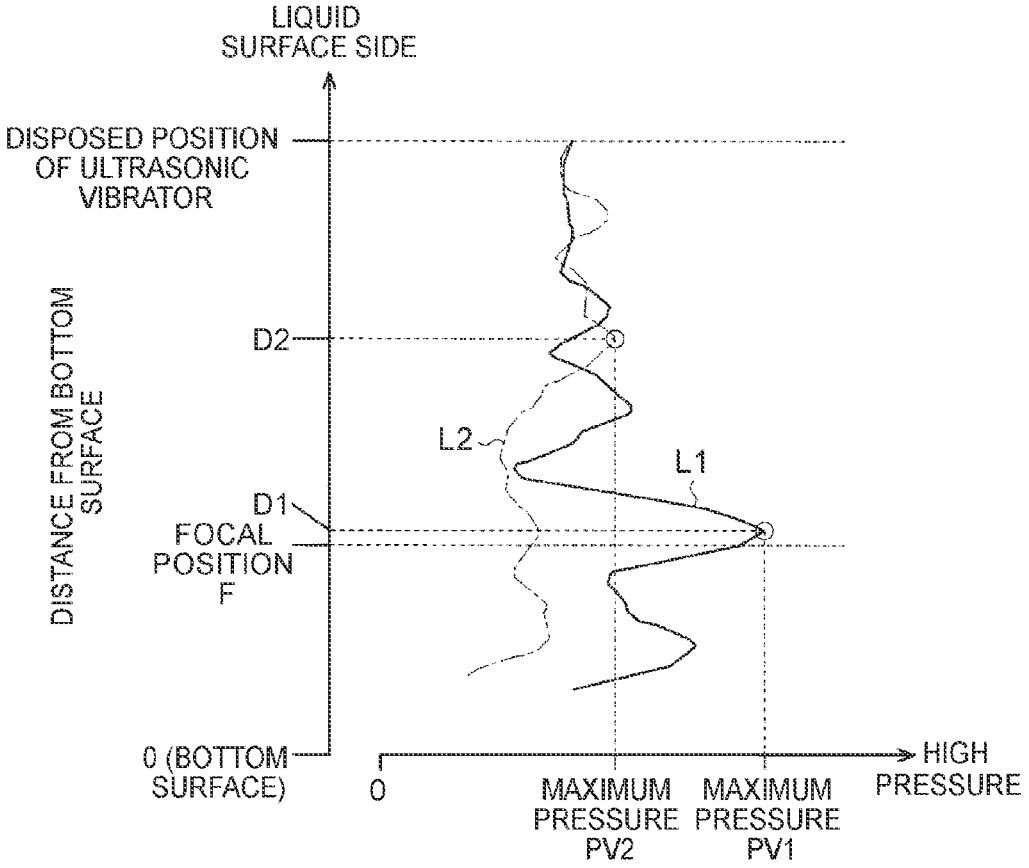
FIG. 2 is a graph showing the change of a maximum pressure position due to deformation of a parabolic surface.

As shown in FIG. 2, an offset between a distance D1 from the bottom surface of the wash tank at which a maximum pressure PV1 was obtained when the shape of the parabolic surface was not changed, and a focal position F of the parabolic surface was smaller than an offset between a distance D2 from the bottom surface of the wash tank at which a maximum pressure PV2 was obtained when the shape of the parabolic surface was changed by vibration, and the focal position F of the parabolic surface. Further, the maximum pressure PV1 obtained when the shape of the parabolic surface was not changed was higher than the maximum pressure PV2 obtained when the shape of the parabolic surface was changed by vibration. Therefore, the simulation results show that as the change in the shape of the parabolic surface decreases, it is possible to further suppress a decrease in the ultrasonic wave focusing effect so that the maximum pressure of the detergent solution increases to enhance the cleaning effect.

In the ultrasonic cleaner 10 of this embodiment, when the wash tank 21 vibrates, the distance between the wash tank 21 and the outer tank 22 changes to deform the vibration-damping material 23 so that the vibration energy is converted to heat. Therefore, the vibration of the wash tank 21 is damped. Consequently, the change in the shape of the parabolic surface 21A due to the vibration of the wash tank 21 decreases so that a decrease in the effect of focusing the ultrasonic wave S is suppressed.

In the meantime, the greater the amplitude of an ultrasonic wave is, the higher the cleaning effect by the ultrasonic wave is. When an ultrasonic wave is emitted in a conic solid toward its tapered distal end portion, the amplitude of the emitted ultrasonic wave is amplified in the conic solid. In this regard, the wash tank 21 is formed in the conical shape such that its external shape tapers toward the parabolic surface 21A from the disposed position of the ultrasonic vibrator 30. Therefore, an ultrasonic wave outputted from the ultrasonic vibrator 30 is amplified in the wash tank 21.

Figure 3:
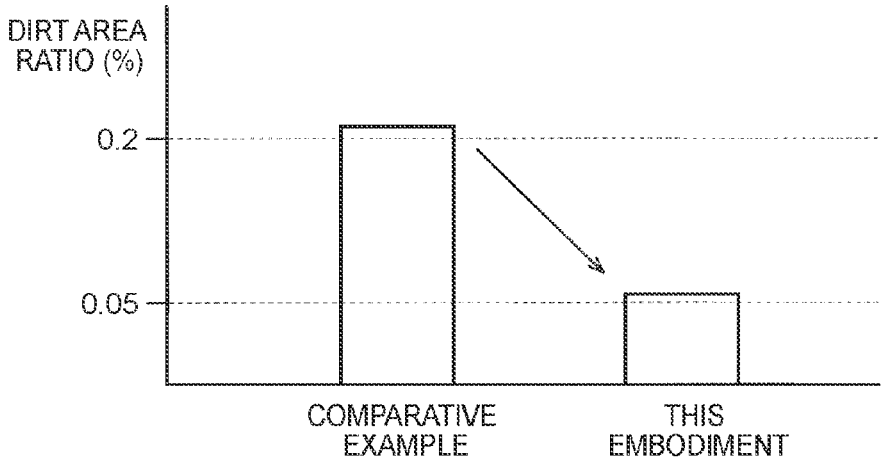
FIG. 3 is a graph showing the cleaning effect by the ultrasonic cleaner of the first embodiment.

FIG. 3 shows the experimental result of a cleaning effect using the ultrasonic cleaner 10 of this embodiment including the wash tank 21 having a shape of the conic solid with the bottom surface of the parabolic shape and the experimental result of a cleaning effect using an ultrasonic cleaner including a wash tank having a rectangular parallelepiped shape with a flat bottom surface (hereinafter referred to as a "comparative example"). The experiment using the ultrasonic cleaner 10 of this embodiment and the experiment using the ultrasonic cleaner of the comparative example differed only in the shape of the wash tanks and were the same in the other cleaning conditions.

In the experiments, a value obtained by dividing a total area S1 of dirt (e.g. residue stains) remaining on surfaces of a cleaning object W after ultrasonic cleaning by a total surface area S2 of the cleaning object W and then multiplying the quotient by 100 was calculated as "dirt area ratio YR (%): YR=S1/S2×100" and this dirt area ratio YR was used as an index value of cleaning effect. A smaller dirt area ratio indicates a higher cleaning effect. The total area S1 of dirt was measured using a well-known laser-type defect inspection apparatus.

As shown in FIG. 3, the dirt area ratio YR in the comparative example was about 0.2%. On the other hand, the dirt area ratio YR in the ultrasonic cleaner 10 of this embodiment was about 0.05%. Therefore, in the ultrasonic cleaner 10 of this embodiment, the dirt area ratio YR was reduced to ¼ compared to the comparative example and thus the improvement of the cleaning effect was confirmed.

According to this embodiment described above, the following effects can be obtained. Since the ultrasonic cleaner 10 includes the vibration-damping material 23 and the outer tank 22 that serve as the attenuation mechanism configured to damp the vibration of the wash tank 21, a decrease in the ultrasonic wave focusing effect by the parabolic surface 21A due to the vibration of the wash tank 21 can be suppressed. Therefore, compared to the case where the attenuation mechanism is not provided, an ultrasonic wave can be irradiated on the cleaning object W more effectively.

The wash tank 21 is formed in the shape of the conic solid such that its external shape tapers toward the parabolic surface 21A from the disposed position of the ultrasonic vibrator 30. Therefore, an ultrasonic wave outputted from the ultrasonic vibrator 30 is amplified so that the cleaning effect for the cleaning object W by the ultrasonic wave can be further enhanced.

Next, referring to FIG. 4, a second embodiment of an ultrasonic cleaner will be described. In the first embodiment described above, the outer tank 22 and the vibration-damping material 23 are used as the attenuation mechanism that damps the vibration of the wash tank 21. On the other hand, in this embodiment, an outer tank 22 and springs are used as an attenuation mechanism that damps the vibration of a wash tank 21. This embodiment differs from the first embodiment only in this point. In this regard, hereinbelow, the ultrasonic cleaner of this embodiment will be described centering on this difference.

Figure 4:
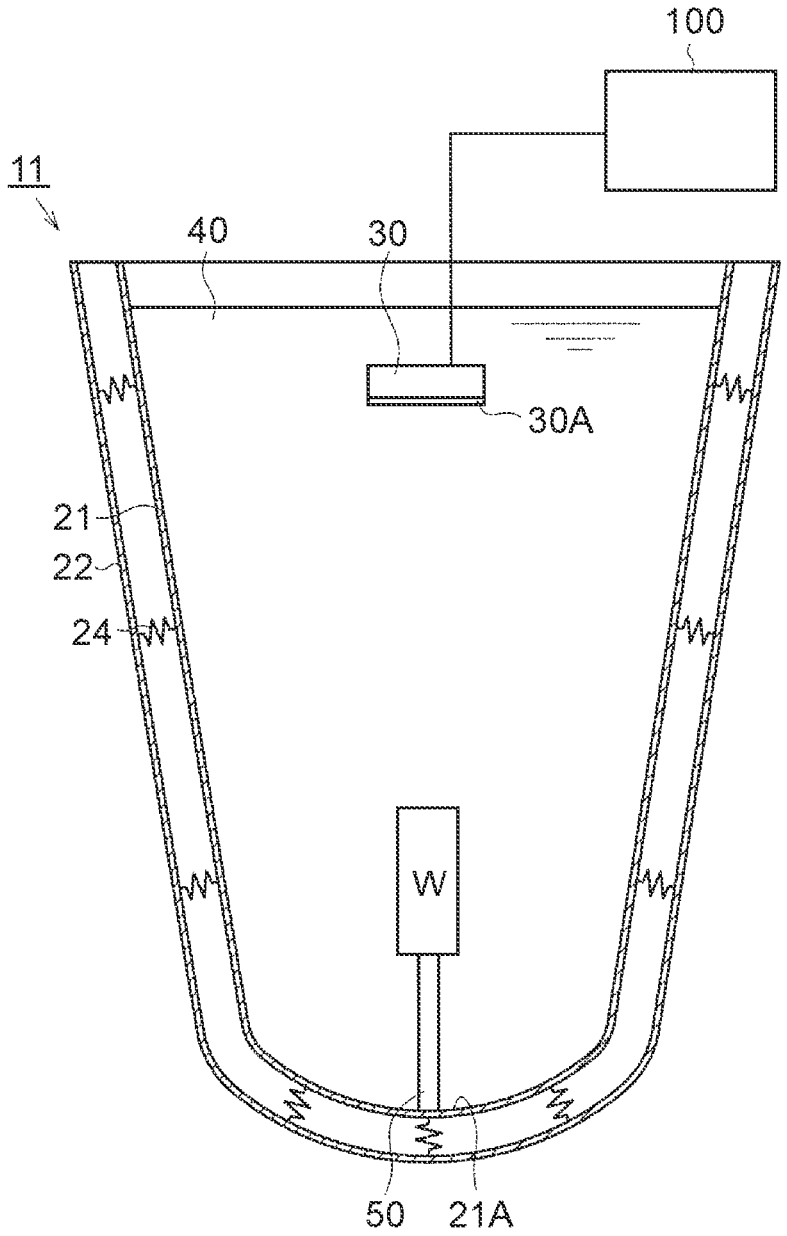
FIG. 4 is a sectional view showing the structure of a wash tank in a second embodiment.

As shown in FIG. 4, an ultrasonic cleaner 11 of this embodiment is configured such that springs 24 connecting between an inner peripheral surface of an outer tank 22 and an outer peripheral surface of a wash tank 21 are provided at a plurality of portions between the inner peripheral surface of the outer tank 22 and the outer peripheral surface of the wash tank 21 so that the wash tank 21 is supported on the inner side of the outer tank 22 by the springs 24.

Also in the ultrasonic cleaner 11 of this embodiment thus configured, when the wash tank 21 vibrates, the distance between the wash tank 21 and the outer tank 22 changes to deform the springs 24 so that the vibration energy is converted to heat. Therefore, the vibration of the wash tank 21 is damped. Consequently, the change in the shape of a parabolic surface 21A due to the vibration of the wash tank 21 decreases so that a decrease in the effect of focusing an ultrasonic wave S is suppressed. Therefore, also in this embodiment, the same actions and effects as in the first embodiment can be obtained.

Figure 5:
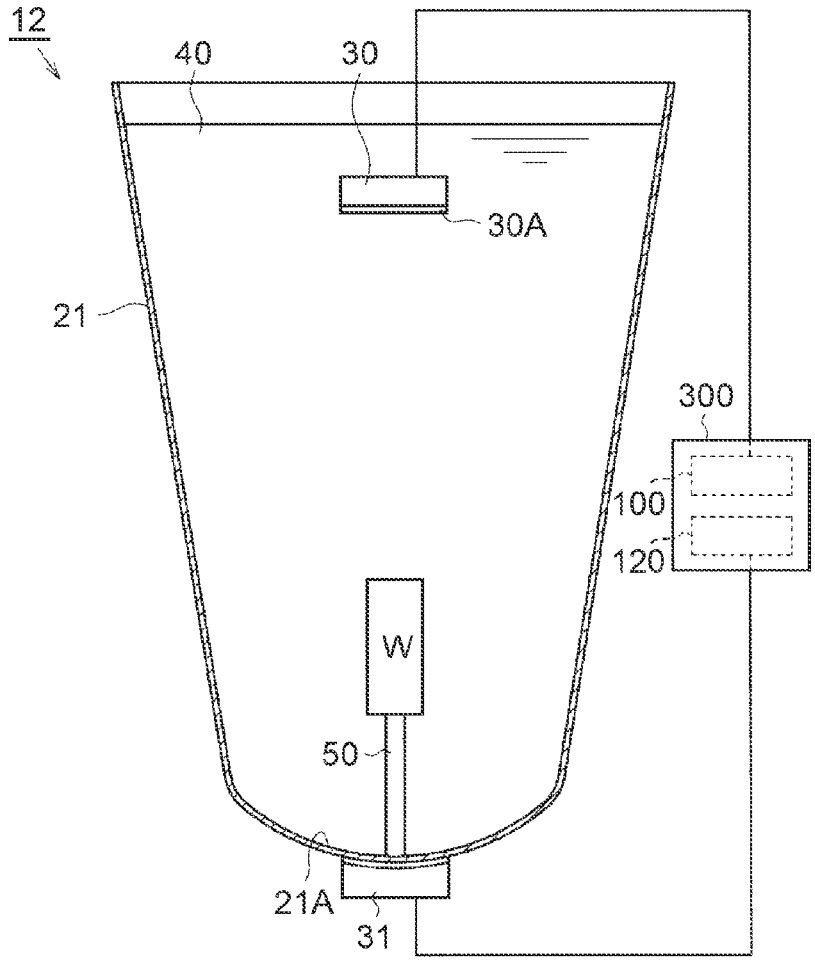
FIG. 5 is a sectional view showing the structure of a wash tank in a third embodiment.

Next, referring to FIGS. 5 and 6, a third embodiment of an ultrasonic cleaner will be described. In the first embodiment described above, the vibration-damping material 23 and the outer tank 22 are used as the attenuation mechanism that damps the vibration of the wash tank 21. On the other hand, in this embodiment, the vibration of a wash tank 21 is damped by applying to the wash tank 21 a waveform that is opposite in phase to a vibration waveform of the wash tank 21.

Hereinbelow, the ultrasonic cleaner of this embodiment will be described centering on the difference from the first embodiment. As shown in FIG. 5, differently from the ultrasonic cleaner 10 of the first embodiment, the outer tank 22 and the vibration-damping material 23 are omitted in an ultrasonic cleaner 12 of this embodiment.

Hereinbelow, the ultrasonic vibrator 30 described above will be referred to as a "first ultrasonic vibrator 30" and the oscillator 100 described above will be referred to as a "first oscillator 100". The ultrasonic cleaner 12 of this embodiment includes, in addition thereto, a second ultrasonic vibrator 31 that differs from the first ultrasonic vibrator 30, and a second oscillator 120 that differs from the first oscillator 100.

The second ultrasonic vibrator 31 is disposed on an outer wall surface of a wash tank 21 at a position facing a vibration surface 30A of the first ultrasonic vibrator 30, i.e. at a position where a parabolic surface 21A is formed.

The second ultrasonic vibrator 31 is connected to the second oscillator 120 that outputs a high-frequency voltage. The frequency and amplitude of an ultrasonic wave emitted from the second ultrasonic vibrator 31 are adjusted by the second oscillator 120. In this embodiment, the first oscillator 100 and the second oscillator 120 are provided in an oscillator 300, but the first oscillator 100 and the second oscillator 120 may be provided independently of each other.

Figure 6:
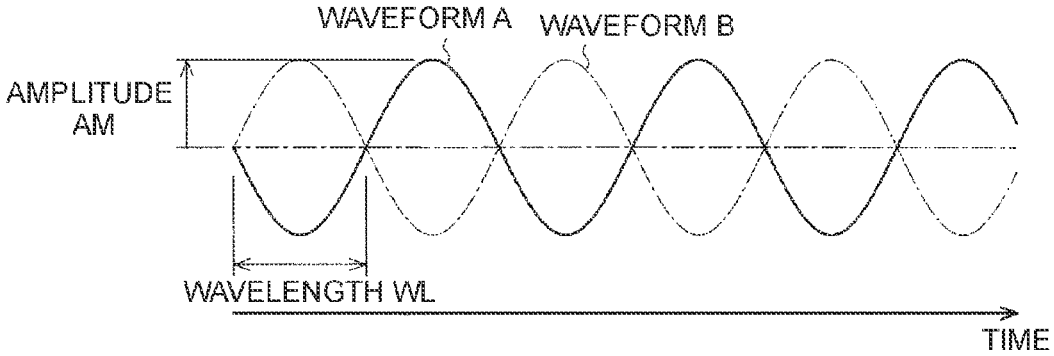
FIG. 6 is a graph showing a vibration waveform of the wash tank and a waveform of an ultrasonic wave outputted from a second ultrasonic vibrator in the third embodiment.

As shown in FIG. 6, it is assumed that a vibration waveform of a portion, where the second ultrasonic vibrator 31 is disposed, of the wash tank 21, i.e. a vibration waveform of the parabolic surface 21A, generated by an ultrasonic wave outputted from the first ultrasonic vibrator 30 is a waveform A and that a waveform that is opposite in phase to the waveform A is a waveform B. More specifically, the waveform B is a waveform whose wavelength WL and amplitude AM are equal to those of the waveform A and whose period is shifted by a half period relative to the waveform A. While ultrasonic cleaning by the first ultrasonic vibrator 30 is carried out, the second oscillator 120 is operated so that an ultrasonic wave of the waveform B is generated from the second ultrasonic vibrator 31.

Next, the actions created by the ultrasonic cleaner 12 of this embodiment will be described. As shown in FIG. 6, in this embodiment, an ultrasonic wave (waveform B) that is opposite in phase to a vibration waveform of the wash tank 21 (waveform A) generated by an ultrasonic wave outputted from the first ultrasonic vibrator 30 is generated from the second ultrasonic vibrator 31. Since the second ultrasonic vibrator 31 is disposed on the outer wall surface of the wash tank 21 at the position where the parabolic surface 21A is formed, the opposite-phase ultrasonic wave generated from the second ultrasonic vibrator 31 is transmitted to the parabolic surface 21A to cancel the vibration of the parabolic surface 21A so that the vibration of the parabolic surface 21A provided to the wash tank 21 is damped. Ideally, in order to cancel the vibration of the parabolic surface 21A, it is desirable that the wavelength and amplitude of the waveform B be equal to those of the waveform A. However, if the wavelength and amplitude of the waveform B are close to those of the waveform A to some extent, it is possible to damp the vibration of the parabolic surface 21A.

In this way, in the ultrasonic cleaner 12 of this embodiment, the vibration of the parabolic surface 21A provided to the wash tank 21 is damped by an attenuation mechanism composed of the second ultrasonic vibrator 31 and the second oscillator 120 so as to be made smaller. Therefore, the change in the shape of the parabolic surface 21A due to the vibration of the wash tank 21 also decreases so that a decrease in the ultrasonic wave focusing effect is suppressed.

According to this embodiment described above, the following effects can be obtained in addition to the effects described in the first embodiment. Since the ultrasonic cleaner 12 includes the second ultrasonic vibrator 31 and the second oscillator 120, a decrease in the ultrasonic wave focusing effect by the parabolic surface 21A due to the vibration of the wash tank 21 can be suppressed. Therefore, compared to the case where the second ultrasonic vibrator 31 and the second oscillator 120 are not provided, an ultrasonic wave can be irradiated on a cleaning object W more effectively.

The second ultrasonic vibrator 31 is disposed on the outer wall surface of the wash tank 21 at the position facing the vibration surface 30A of the first ultrasonic vibrator 30. Therefore, the vibration of the parabolic surface 21A provided to the wash tank 21 can be directly damped by an ultrasonic wave.

The embodiments described above can be carried out with the following changes. While the wash tank 21 has the conical shape, it may have a pyramid shape. In the third embodiment, the second ultrasonic vibrator 31 is disposed on the outer wall surface of the wash tank 21 at the position facing the first ultrasonic vibrator 30, but the disposing position of the second ultrasonic vibrator 31 can be changed as appropriate as long as it is a wall surface of the wash tank 21. For example, the second ultrasonic vibrator 31 may be disposed at a position different from the position facing the first ultrasonic vibrator 30. Even in this case, the vibration of the wash tank 21 at a portion where the second ultrasonic vibrator 31 is disposed is damped by an opposite-phase ultrasonic wave outputted from the second ultrasonic vibrator 31. When the vibration of the wash tank 21 at the portion where the second ultrasonic vibrator 31 is disposed is damped in this way, the vibration of the wash tank 21 at the other portions where the second ultrasonic vibrator 31 is not disposed is also damped and therefore the vibration of the parabolic surface 21A provided to the wash tank 21 is also damped. Therefore, also in this modification, the change in the shape of the parabolic surface 21A due to the vibration of the wash tank 21 can be made smaller.

The second ultrasonic vibrator 31 may be disposed on an inner wall surface of the wash tank 21. In the third embodiment, the single second ultrasonic vibrator 31 is disposed on the wall surface of the wash tank 21.

Figure 7:
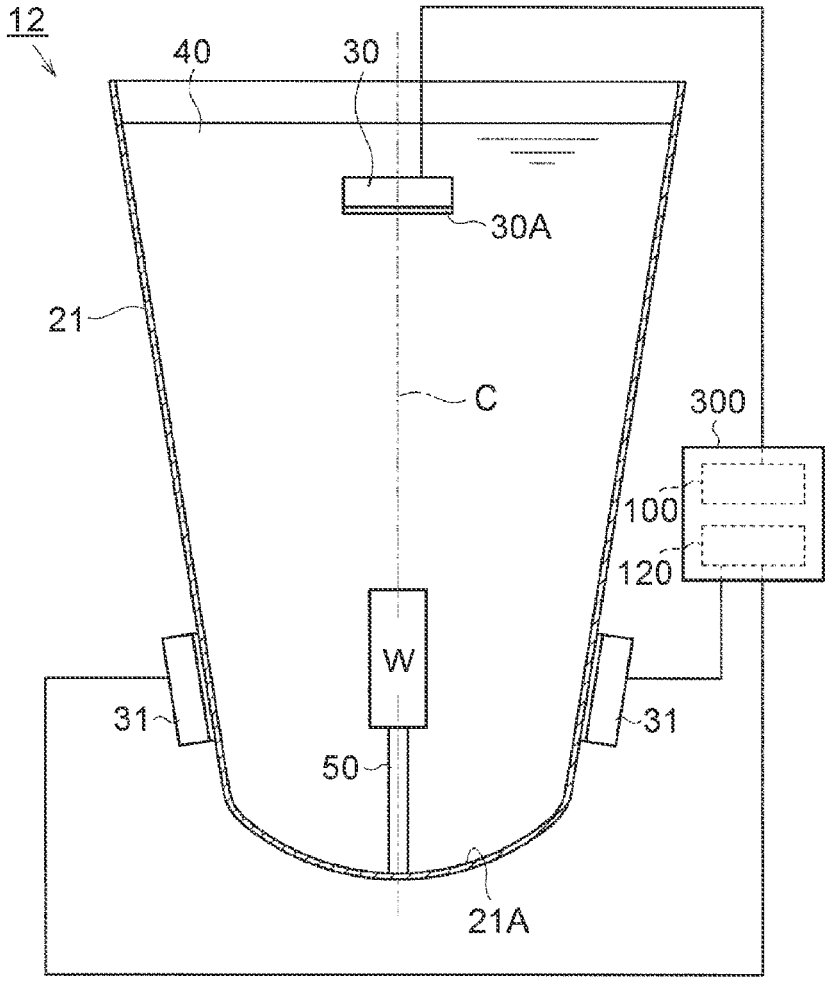
FIG. 7 is a sectional view showing the structure of a wash tank of an ultrasonic cleaner in a modification of the third embodiment.

Alternatively, as shown in FIG. 7, a plurality of second ultrasonic vibrators 31 may be disposed on the wall surface of the wash tank 21. FIG. 7 shows, by way of example, a case where two second ultrasonic vibrators 31 are disposed. Since vibration waveforms of the wash tank 21 differ from each other according to portions of the wash tank 21, when disposing the plurality of second ultrasonic vibrators 31, in some embodiments the second ultrasonic vibrators 31 are disposed at portions, where the vibration waveforms will be the same as each other, of the wash tank 21. The portions where the vibration waveforms will be the same as each other are, for example, as shown in FIG. 7, portions that are in line symmetry with respect to a central axis C of the wash tank 21 having the conical shape.

Figure 8:
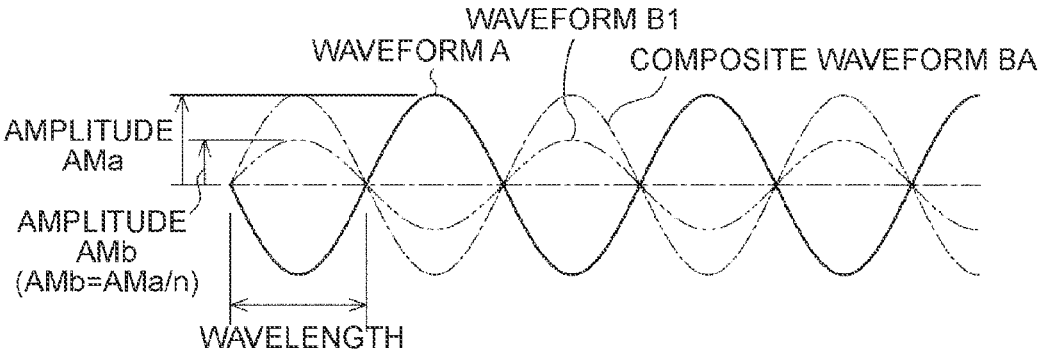
FIG. 8 is a graph showing a vibration waveform of the wash tank and a waveform of an ultrasonic wave outputted from a second ultrasonic vibrator in the modification.

In this modification, an ultrasonic wave described below is outputted from each second ultrasonic vibrator 31. As shown in FIG. 8, it is assumed that an amplitude AM of a vibration waveform of the wash tank 21 (waveform A shown in FIG. 8) generated by an ultrasonic wave outputted from the first ultrasonic vibrator 30 is an amplitude AMa. Further, it is assumed that an amplitude AM of an ultrasonic wave (waveform B1 shown in FIG. 8) outputted from each second ultrasonic vibrator 31 is an amplitude AMb. It is further assumed that the number of the disposed second ultrasonic vibrators 31 is "n" (n 2). Then, the output of the second oscillator 120 configured to vibrate the second ultrasonic vibrators 31 is adjusted so that the waveform B1 of the ultrasonic wave outputted from each second ultrasonic vibrator 31 becomes a waveform that is opposite in phase to the waveform A and that the amplitude AMb of the waveform B1 takes a value obtained by dividing the amplitude AMa of the waveform A by "n". Then, the ultrasonic waves of the waveform B1 are simultaneously outputted from the second ultrasonic vibrators 31.

In this case, a composite waveform BA of the ultrasonic waves outputted from the second ultrasonic vibrators 31 becomes a waveform that is opposite in phase to the waveform A and has an amplitude AM equal to the amplitude AMa of the waveform A, and therefore, the vibration of the wash tank 21 is damped by cancellation between the opposite-phase composite waveform BA and the waveform A. Ideally, in order to cancel the vibration of the wash tank 21, it is desirable that the wavelength of the waveform B1 be equal to the wavelength of the waveform A and that the amplitude AMb of the waveform B1 be equal to the value obtained by dividing the amplitude AMa of the waveform A by "n". However, even if the wavelength of the waveform B1 and the wavelength of the waveform A slightly differ from each other, it is possible to damp the vibration of the wash tank 21. Likewise, even if the amplitude AMb of the waveform B1 and the value obtained by dividing the amplitude AMa of the waveform A by "n" slightly differ from each other, it is possible to damp the vibration of the wash tank 21.

The shape of the outer tank 22 is not necessarily similar to the shape of the wash tank 21. For example, the wash tank 21 may have a conical shape, while the outer tank 22 may have a cylindrical shape. In the embodiments and their modifications described above, the wash tank 21 and the outer tank 22 have shapes of the conic solid. However, the effects created by including the wash tank 21 having the parabolic surface 21A and the attenuation mechanism that damps the vibration of the wash tank 21 can also be obtained even when the wash tank 21 and the outer tank 22 have shapes other than the shapes of the conic solid. Accordingly, the shapes of the wash tank 21 and the outer tank 22 can be changed as appropriate.

Figure 9:
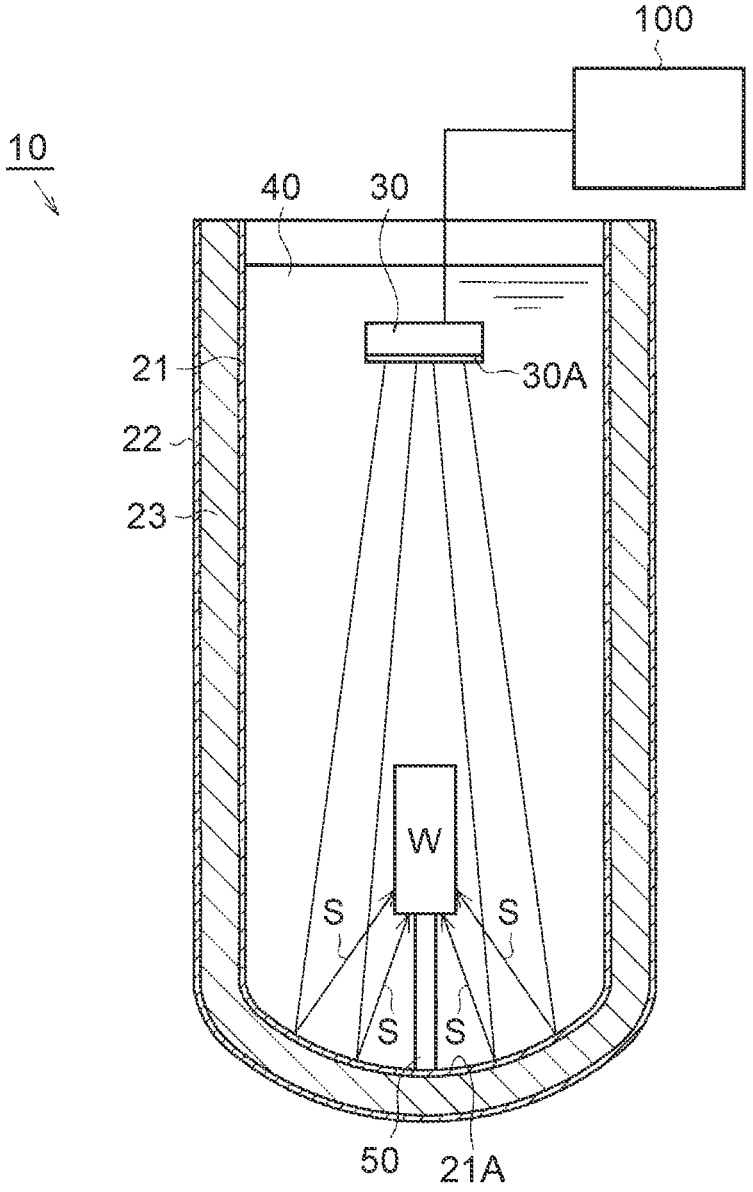
FIG. 9 is a sectional view showing the structure of a wash tank of an ultrasonic cleaner in a modification of the first embodiment.

For example, as shown in FIG. 9, the wash tank 21 and the outer tank 22 in the first embodiment may each have a cylindrical shape or a prism shape. Likewise, the wash tank 21 and the outer tank 22 in the second embodiment may each have a cylindrical shape or a prism shape. Likewise, the wash tank 21 in the third embodiment may have a cylindrical shape or a prism shape.

The invention claimed is:

1. An ultrasonic cleaner comprising:

a first ultrasonic vibrator configured to generate a first ultrasonic wave;

a first oscillator configured to drive the first ultrasonic vibrator;

a wash tank configured to store a detergent solution, the wash tank including a parabolic surface, the parabolic surface being a recessed surface facing a vibration surface of the first ultrasonic vibrator, the parabolic surface configured to reflect the first ultrasonic wave to a focal position where an object to be cleaned is placed; and an attenuation mechanism configured to damp vibration of the wash tank, the vibration of the wash tank being generated by the first ultrasonic wave impinging on the wash tank, the attenuation mechanism includes an outer tank housing the wash tank, and a vibration-damping material that fills a space between an outer peripheral surface of the wash tank and an inner peripheral surface of the outer tank.

2. The ultrasonic cleaner according to claim 1, wherein the wash tank has a shape of a conic solid such that an external shape tapers toward the parabolic surface from a disposed position of the first ultrasonic vibrator.

3. An ultrasonic cleaner comprising:

a first ultrasonic vibrator configured to generate a first ultrasonic wave;

a first oscillator configured to drive the first ultrasonic vibrator;

a wash tank configured to store a detergent solution, the wash tank including a parabolic surface, the parabolic surface being a recessed surface facing a vibration surface of the first ultrasonic vibrator, the parabolic surface configured to reflect the first ultrasonic wave to a focal position where an object to be cleaned is placed; and an attenuation mechanism configured to damp vibration of the wash tank, the vibration of the wash tank being generated by the first ultrasonic wave impinging on the wash tank, wherein the attenuation mechanism includes a second ultrasonic vibrator disposed on a wall surface of the wash tank and a second oscillator, the second oscillator is configured to generate a second ultrasonic wave from the second ultrasonic vibrator, and a waveform of the second ultrasonic wave is opposite in phase to a vibration waveform of a portion, where the second ultrasonic vibrator is disposed, of the wash tank generated by the first ultrasonic wave.

4. The ultrasonic cleaner according to claim 3, wherein the second ultrasonic vibrator is disposed on the wall surface of the wash tank at a portion facing the vibration surface of the first ultrasonic vibrator.

5. The ultrasonic cleaner according to claim 3, wherein a plurality of the second ultrasonic vibrators are disposed on the wall surface of the wash tank, and vibration waveforms of the wash tank at positions where the plurality of the second ultrasonic vibrators are disposed are the same as each other.

6. The ultrasonic cleaner according to claim 3, wherein the wash tank has a shape of a conic solid such that an external shape tapers toward the parabolic surface from a disposed position of the first ultrasonic vibrator.

7. An ultrasonic cleaner comprising:

a first ultrasonic vibrator configured to generate a first ultrasonic wave;

a first oscillator configured to drive the first ultrasonic vibrator;

a wash tank configured to store a detergent solution, the wash tank including a parabolic surface, the parabolic surface being a recessed surface facing a vibration surface of the first ultrasonic vibrator, the parabolic surface configured to reflect the first ultrasonic wave to a focal position where an object to be cleaned is placed; and an attenuation mechanism configured to damp vibration of the wash tank, the vibration of the wash tank being generated by the first ultrasonic wave impinging on the wash tank, wherein the attenuation mechanism includes an outer tank having a shape that corresponds to a shape of the wash tank, the outer tank houses the wash tank, and a spring disposed between an inner peripheral surface of the outer tank and an outer peripheral surface of the wash tank so as to support the wash tank on an inner side of the outer tank, wherein an entire shape of the inner peripheral surface of the outer tank is geometrically similar to an entire shape of the outer peripheral surface of the wash tank.

8. The ultrasonic cleaner according to claim 7, wherein the wash tank has a shape of a conic solid such that an external shape tapers toward the parabolic surface from a disposed position of the first ultrasonic vibrator.

* * * * *